US010844297B2

(12) United States Patent
Creyghton et al.

(10) Patent No.: US 10,844,297 B2
(45) Date of Patent: Nov. 24, 2020

(54) RESIDUAL BASE OIL PROCESS

(71) Applicant: SHELL OIL COMPANY, Houston, TX (US)

(72) Inventors: Edward Julius Creyghton, Amsterdam (NL); Julija Romanuka, The Hague (NL)

(73) Assignee: SHELL OIL COMPANY, Houston, TX (US)

( * ) Notice: Subject to any disclaimer, the term of this patent is extended or adjusted under 35 U.S.C. 154(b) by 32 days.

(21) Appl. No.: 16/064,038

(22) PCT Filed: Dec. 23, 2016

(86) PCT No.: PCT/EP2016/082589

§ 371 (c)(1),
(2) Date: Jun. 20, 2018

(87) PCT Pub. No.: WO2017/109191

PCT Pub. Date: Jun. 29, 2017

(65) Prior Publication Data

US 2019/0002774 A1 Jan. 3, 2019

(30) Foreign Application Priority Data

Dec. 23, 2015 (EP) ..... 15202575

(51) Int. Cl.
*C10G 69/10* (2006.01)
*C10M 171/02* (2006.01)
(Continued)

(52) U.S. Cl.
CPC ..... *C10G 69/10* (2013.01); *C10G 65/043* (2013.01); *C10G 65/12* (2013.01); *C10M 105/02* (2013.01);
(Continued)

(58) Field of Classification Search
None
See application file for complete search history.

(56) References Cited

U.S. PATENT DOCUMENTS 3,660,273 A 5/1972 Cummins
3,670,888 A 6/1972 Boroughs et al.
(Continued)

FOREIGN PATENT DOCUMENTS

EP 0807656 A1 11/1997
EP 1134248 A1 9/2001
(Continued)

OTHER PUBLICATIONS

International Search Report and Written Opinion received for PCT Patent Application No. PCT/EP2016/082589, dated Feb. 6, 2017, 9 pages.
(Continued)

*Primary Examiner* — Derek N Mueller

(57) ABSTRACT

The present invention relates to a Fischer-Tropsch derived residual base oil having a kinematic viscosity at 100° C. according to ASTM D445 in the range of from 15 to 35 $mm^2/s$, an average number of carbon atoms per molecule Fischer-Tropsch derived residual base oil according to $^{13}C$-NMR in a range of from 25 to 50.

9 Claims, 2 Drawing Sheets

(51) Int. Cl.

| | |
|---|---|
| ***C10M 109/02*** | (2006.01) |
| ***C10G 65/12*** | (2006.01) |
| ***C10M 171/04*** | (2006.01) |
| ***C10G 65/04*** | (2006.01) |
| ***C10M 107/02*** | (2006.01) |
| ***C10M 105/02*** | (2006.01) |
| *C10N 20/02* | (2006.01) |
| *C10N 30/02* | (2006.01) |

(52) U.S. Cl.

CPC ..... *C10M 107/02* (2013.01); *C10M 109/02* (2013.01); *C10M 171/02* (2013.01); *C10M 171/04* (2013.01); *C10G 2300/1022* (2013.01); *C10G 2300/304* (2013.01); *C10G 2400/10* (2013.01); *C10M 2205/173* (2013.01); *C10N 2020/02* (2013.01); *C10N 2030/02* (2013.01)

(56) References Cited

U.S. PATENT DOCUMENTS

| | | | | |
|---|---|---|---|---|
| 4,096,168 | A | 6/1978 | Hallgren | |
| 4,892,822 | A | 1/1990 | Abramowicz et al. | |
| 5,354,923 | A | 10/1994 | Schon et al. | |
| 5,589,564 | A | 12/1996 | Komiya et al. | |
| 7,763,745 | B2 | 7/2010 | Van Der Heide et al. | |
| 2004/0152861 | A1 | 8/2004 | Nefzger et al. | |
| 2010/0236990 | A1* | 9/2010 | Gleeson | C10G 29/02 208/289 |
| 2011/0083995 | A1 | 4/2011 | Gleeson et al. | |
| 2015/0203769 | A1* | 7/2015 | Kieffer | C10G 45/62 208/59 |

FOREIGN PATENT DOCUMENTS

| | | | |
|---|---|---|---|
| EP | 2341122 | A1 | 7/2011 |
| JP | 6416826 | A | 1/1989 |
| WO | 02070627 | A2 | 9/2002 |
| WO | 2005047439 | A2 | 5/2005 |
| WO | 2009080681 | A2 | 7/2009 |
| WO | 2014001546 | A1 | 1/2014 |
| WO | 2014189879 | A1 | 11/2014 |

OTHER PUBLICATIONS

Sarpal et al., "Hydrocarbon Characterization of Hydrocracked Base Stocks by One- and Two-Dimensional NMR Spectroscopy", Fuel, Mar. 1996, vol. 75, Issue No. 4, pp. 483-490.

Makela et al., "Automating the NMR Analysis of Base Oils: Finding Napthene Signals", Fuel, Sep. 2013, vol. 111, pp. 543-554.

* cited by examiner

RESIDUAL BASE OIL PROCESS

CROSS REFERENCE TO RELATED APPLICATIONS

This is a national stage application of International Application No. PCT/EP2016/082589, filed 23 Dec. 2016, which claims benefit of priority to European Patent Application No. 15202575.5, filed 23 Dec. 2015.

FIELD OF THE INVENTION

The present invention relates to a Fischer-Tropsch derived residual base oil and a process to prepare said residual base oil.

BACKGROUND OF THE INVENTION

It is known in the art that waxy hydrocarbon feeds, including those synthesized from gaseous components such as CO and $H_2$, especially Fischer-Tropsch waxes, are suitable for conversion/treatment into base oils by subjecting such waxy feeds to hydroisomerization/hydrocracking whereby long chain normal-paraffins and slightly branched paraffins are removed and/or rearranged/isomerized into more heavily branched iso-paraffins of reduced pour and cloud point. Base oils produced by the conversion/treatment of waxy hydrocarbon feeds of the type synthesized from gaseous components (i.e. from Fischer-Tropsch feedstocks), are referred to herein as Fischer-Tropsch derived base oils, or simply FT base oils.

It is known in the art how to prepare so-called Fischer-Tropsch residual (or bottoms) derived base oils, referred to hereinafter as FT residual base oils. Such FT residual base oils are often obtained from a residual (or bottoms) fraction resulting from distillation of an at least partly isomerised Fischer-Tropsch feedstock. The at least partly isomerised Fischer-Tropsch feedstock may itself have been subjected to processing, such as dewaxing, before distillation. The residual base oil may be obtained directly from the residual fraction, or indirectly by processing, such as dewaxing. A residual base oil may be free from distillate, i.e. from side stream product recovered either from an atmospheric fractionation column or from a vacuum column. WO02/070627, WO2009/080681 and WO2005/047439 describe exemplary processes for making Fischer-Tropsch derived residual base oils.

FT base oils, have found use in a number of lubricant applications on account of their excellent properties, such as their beneficial viscometric properties and purity. The FT base oils, and in particular residual FT base oils can suffer from an undesirable appearance in the form of a waxy haze at ambient temperature. Waxy haze may be inferred or measured in a number of ways. The presence of waxy haze may for instance be measured according to ASTM D4176-04 which determines whether or not a fuel or lubricant conforms with a "clear and bright" standard. Whilst ASTM D4176-04 is written for fuels, it functions too for base oils. Waxy haze in FT residual base oils, which can also adversely affect the filterability of the oils, is assumed to result from the presence of long carbon chain length paraffins, which have not been sufficiently isomerised (or cracked).

In the prior art the presence of waxy haze in the Fischer-Tropsch derived residual base oil is attributed often to the presence of long carbon chain length paraffins, which have not been sufficiently isomerized (or cracked).

However, these molecules have never been characterized and the prior art neither disclose the characterization of the molecules causing the haze in the FT residual base oil nor the characterization of the haze free FT residual base oil.

It is therefore an object of the invention to provide a characterization method for determining the structure of the molecules causing haze and of the haze free FT residual base oil.

It is a further object of the present invention to monitor the presence of molecules causing haze in the FT residual base oil.

Another object of the present invention is to optimize the process conditions for the preparation of FT residual base oil and to eliminate the haze.

SUMMARY OF THE INVENTION

From a first aspect, above and other objects may be achieved according to the present invention by providing a Fischer-Tropsch derived residual base oil having a kinematic viscosity at 100° C. in the range of from 15 to 35 $mm^2/s$, an average number of carbon atoms per molecule Fischer-Tropsch derived residual base oil according to $^{13}C$-NMR in a range of from 25 to 50.

It has been found according to the present invention that a Fischer-Tropsch (FT) derived residual base oil can be characterized with $^{13}C$-NMR. An advantage of the present invention is that besides the characterization of the clear and bright FT derived base oil, also the hazy FT derived base oil and the isolated wax are characterized with $^{13}C$-NMR. In this way, the structure of said compounds can be determined. The knowledge of these structures may help in optimizing the process conditions to obtain haze free or clear and bright FT derived base oil.

From a second aspect, the invention embraces a process to prepare a FT derived residual base oil. It has been found according to the present invention that the hazy appearance of the waxy haze in FT residual base oils can be reduced effectively when these base oils are subjected to a centrifuging step.

An advantage is that the isolated wax causing the hazy appearance of the FT derived residual base oil and the clear and bright base oil prepared according to the process according to the present invention are characterized by $^{13}C$-NMR. In this way, the process conditions can be optimized to obtain a clear and bright FT derived residual base oil.

BRIEF DESCRIPTION OF THE FIGURE

A more particular description of the invention, briefly summarized above, may be had by reference to the embodiments thereof which are illustrated in the appended drawings and described herein. It is to be noted, however, that the appended drawings illustrate only some embodiments of the invention and therefore not to be considered limited of its scope for the invention may admit to other equally effective embodiments.

DETAILED DESCRIPTION OF THE INVENTION

Figure 1:
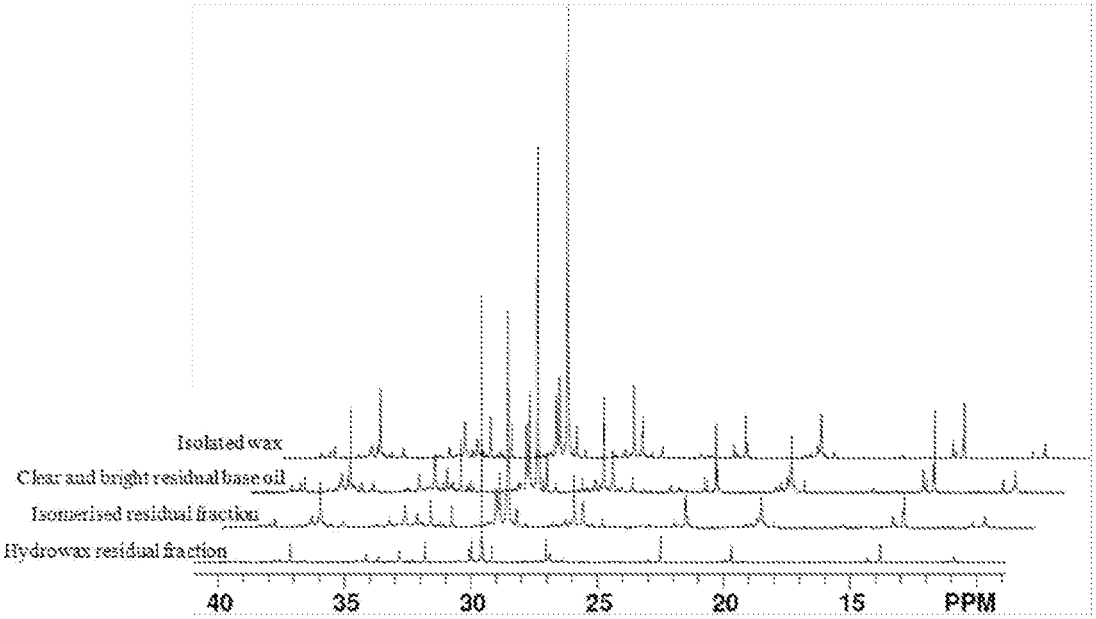
FIG. 1 shows the quantitative 13C NMR spectra of hydrowax residual fraction, isomerized residual fraction, clear and bright residual base oil and isolated wax samples in the 9-41 ppm region.

According to the present invention a Fischer-Tropsch derived residual base oil has a kinematic viscosity according to ASTM D445 at 100° C. in the range of from 15 to 35 $mm^2/s$, an average number of carbon atoms per molecule Fischer-Tropsch derived residual base oil according to $^{13}C$-NMR is in a range of from 25 to 50.

The Fischer-Tropsch derived residual base oil is derived from a Fischer-Tropsch process. Fischer-Tropsch product stream is known in the art. By the term "Fischer-Tropsch derived" is meant a residual base oil is, or is derived from a Fischer-Tropsch process. A Fischer-Tropsch derived residual base oil may also be referred to as GTL (Gas-to-Liquids) product. WO02/070627, WO2009/080681 and WO2005/047439 describe exemplary processes for making Fischer-Tropsch derived residual base oil.

Preferably, the average number of carbon atoms per molecule FT derived residual base oil according to $^{13}C$-NMR is in a range of from 30 to 45. More preferably, the average number of carbon atoms per molecule FT derived residual base oil according to $^{13}C$-NMR is in a range of from 31 to 45. Even more preferably, the average number of carbon atoms per molecule FT derived residual base oil according to $^{13}C$-NMR is in a range of from 32 to 45 and most preferably in a range of from 35 to 45.

The Fischer-Tropsch derived residual base oil preferably has an average number of carbons in the non-branched segment according to $^{13}C$-NMR of less than 14. The length of a non-branched segment is defined as an average number of carbons that are surrounded by at least 2 methylene groups in both directions.

Suitably, the Fischer-Tropsch derived residual base oil has an average number of branches normalized for a molecule of 50 carbon atoms according to $^{13}C$-NMR of at least 3.5, preferably at least 4.0. The term average number of branches is defined as an average number of alkyl groups on a tertiary carbon where the alkyl group could be a methyl, an ethyl, a propyl or longer.

The method $^{13}C$-NMR is known in the art and is therefore not discussed here in detail.

Typically, quantitative $^{13}C$ and APT (Attached Proton Test) NMR spectra are recorded using an Agilent 400 MHz spectrometer equipped with a 5 mm probe. To prepare NMR samples, approximately 25 wt % solution of the Fischer-Tropch derived residual base oil is preferably prepared in deuterated chloroform solvent. Spectra of this sample is preferably acquired at 40° C. To prepare an NMR sample of the hydrowax residue fraction sample, a small amount is preferably scooped and dissolved in deuterated tetrachloroethane. To keep this sample in a liquid state, the temperature in the NMR spectrometer was raised to 120° C. All NMR samples for a quantitative analysis contained tris (acetylacetonato) chromium (III), which acted as a relaxation agent to induce the spin-lattice relaxation and reduce therefore $T_1$ relaxation time. Between 22000 and 10000 scans are preferably acquired depending on the concentration of the sample. The relaxation delay is 5 s. For $^{13}C$ NMR experiments an inverse gated decoupling scheme is used to suppress unwanted nuclear Overhauser enhancement (NOE). The spectra are processed and integrated using NutsPro—NMR Utility Transform Software—Professional. Chemical shifts are measured relative to tetramethylsilane (TMS) that is used as an internal standard. The peak assignments are based on the literature reports, for example in pp. 483-490 of "Fuel", Sarpal et. Al, Vol. 75, No. 4, 1996, Elsevier. Chemical shifts predictions are generated by an NMR simulator, ACD/C+H NMR Predictors (ACD/C+H Predictors and DB 2012, version 14.00, Advanced Chemistry Development, Inc., Toronto, ON, Canada, www.acdlabs.com, 2012).

The average number of carbon atoms in the molecule was determined using formula 1. To determine the average number of carbon atoms per molecule the value of the total integral was divided by the value of the integral corresponding to the terminal carbons and multiplied by 2 to correct for two terminal carbons. In a similar manner, the number of carbon atoms in the non-branched portion of the molecule was determined using formula 2. Calculations of the length of the non-branched region in base oil is for example described in "Fuel, V. Mäkelä et. al, Vol. 111 (2013) 543-554. Average number of methyl, ethyl and propyl+ branches per molecule was determined using formulas 3, 4 and 5, respectively.

Average number of branches per molecule is a sum of number of methyl, ethyl and propyl+ branches. The average number of branches within a molecule should be considered together with the average molecular size as defined by the average carbon number of the molecules.

$$\text{Average number of carbons, } C_n^* = 2^* I_{aliphatic\ total\ signal}/I_{terminal\ signal} \quad \text{(Formula 1)}$$

$$\text{Average } C_n \text{ non-branched, } C_n = 2^* I_{non\text{-}branched}/I_{terminal\ signal} \quad \text{(Formula 2)}$$

$$\text{Average number of methyl branches per molecule} = 2^* I_{methyl\ branches}/I_{terminal\ signal} \quad \text{(Formula 3)}$$

$$\text{Average number of ethyl branches per molecule} = 2^* I_{ethyl\ branches}/I_{terminal\ signal} \quad \text{(Formula 4)}$$

$$\text{Average number of propyl+branches per molecule} = 2^* I_{propyl+branches}/I_{terminal\ signal} \quad \text{(Formula 5)}$$

Suitably, the Fischer-Tropsch derived residual base oil has a T10 wt. % recovery point in the range of from 470 to 590° C., a T50 wt. % recovery point in the range of from 550 to 710° C., a T80 wt. % recovery point of at least 630° C. and a T90 wt. % recovery point of at least 700° C. as measured with ASTM D7169.

T10, T50, T80 or T90 is the temperature corresponding to the atmospheric boiling point at which a cumulative amount of 10 wt. %, 50 wt. %, 80 wt. % or 90 wt. % of the product is recovered, determined using for example a gas chromatographic method such as ASTM D7169.

Preferably, the Fischer-Tropsch derived residual base oil has a pour point of less than −10° C., preferably less than −20° C. or lower as measured according to ASTM D97. Also, the Fischer-Tropsch derived residual base oil preferably has a cloud point of below 0° C. as measured according to ASTM D2500.

In another aspect, the present invention provides a process to prepare a Fischer-Tropsch derived residual base oil, which process comprises the steps of:

(a) providing a hydrocarbon feed which is derived from a Fischer-Tropsch process;
(b) subjecting the hydrocarbon feed of step (a) to a hydrocracking/hydroisomerisation step to obtain an at least partially isomerised product;
(c) separating at least part of the at least partially isomerised product as obtained in step (b) into one or more lower boiling fractions and a hydrowax residue fraction;
(d) catalytic dewaxing of the hydrowax residue fraction of step (c) to obtain a highly isomerised product;
(e) separating the highly isomerised product of step (d) into one or more light fractions and a isomerised residual fraction;
(f) mixing of the isomerised residual fraction of step (e) with a diluent to obtain a diluted isomerised residual fraction;

(g) cooling the diluted isomerised residual fraction of step (f) to a temperature between 0° C. and −60° C.

(i) subjecting the mixture of step (g) to a centrifuging step at a temperature between 0° C. and −60° C. to isolate the wax from the diluted isomerised residual fraction; and (j) separating the diluent from the diluted isomerised residual fraction to obtain a Fischer-Tropsch derived residual base oil.

In step (c) of the process according to the present invention a hydrowax residue fraction is obtained. The hydrowax residue fraction has preferably an average number of carbon atoms per molecule hydrowax residue fraction according to $^{13}$C-NMR is in a range of from 40 to 65, more preferably in a range of from 45 to 60 carbon atoms per molecule hydrowax residue fraction. Also, the hydrowax residue fraction preferably has an average number of carbons in the non-branched segment according to $^{13}$C-NMR of at least 15, preferably at least 20 carbon atoms.

Suitably, the hydrowax residue fraction has an average number of branches normalized for a molecule of 50 carbon atoms according to $^{13}$C-NMR of at most 3.0.

In step (e) of the process according to the present invention an isomerised residual fraction is obtained. The isomerised residual fraction has preferably an average number of carbon atoms per molecule isomerised residual fraction according to $^{13}$C-NMR is in a range of from 30 to 55, more preferably in a range of from 35 to 50 carbon atoms per molecule isomerised residual fraction. Also, the isomerised residual fraction preferably has an average number of carbons in the non-branched portion according to $^{13}$C-NMR of more than 11 carbon atoms.

Suitably, the isomerised residual fraction has an average number of branches normalized for a molecule of 50 carbon atoms according to $^{13}$C-NMR of at least 3.5, preferably at least 4.0.

In step (i) of the process according to the present invention a wax is isolated.

The isolated wax has preferably an average number of carbon atoms per molecule isolated wax according to $^{13}$C-NMR of at least 40 carbon atoms per molecule isolated wax. Also, the isolated wax preferably has an average number of carbons in the non-branched portion according to $^{13}$C-NMR in a range of at least 15 carbon atoms.

Suitably, the isolated wax has an average number of branches normalized for a molecule of 50 carbon atoms according to $^{13}$C-NMR of at most 3.5.

The average number of carbons per molecule, average number of carbons in the non-branched portion and the average number of branches per molecule normalized for a molecule of 50 carbon atoms for the hydrowax residual fraction, isomerised residual fraction and the isolated wax centrifuged are determined as described above for the clear and bright Fischer-Tropsch derived residual base oil.

The present invention is described below with reference to the following Examples, which are not intended to limit the scope of the present invention in any way.

Example 1

Use of Centrifuging to Prepare and Obtain Hydrowax Residue, Isomerized Residual Fraction, Isolated Wax and Clear and Bright Residual Base Oil From a Fischer Tropsch derived hydrocarbon feed, through a hydrocracking step (60 bar, 330-360° C.) and subsequent atmospheric and vacuum distillation a vacuum hydrowax residue was obtained (congealing point=103° C.). This vacuum hydrowax residue (HVU bottom) was subjected to a catalytic dewaxing step and subsequent distillation. The isomerized residual fraction, with a density of D70/4=0.805, a kinematic viscosity according to ASTM D445 at 100° C. of 21.2 mm$^2$/s, a pour point of PP=−24° C. and a cloud point of cp=42° C., was mixed with Petroleum Ether 40/60) in a ratio of 2 parts by weight of diluent to 1 part by weight of isomerized residual fraction. The diluted isomerized residual fraction was cooled to a temperature of −30° C. The cooled diluted isomerized residual fraction was exposed to a high rotation speed of 14000 RPM (equivalent to a Relative Centrifugal Force (RCF)=21000 g force) in a cooled laboratory centrifuge for a period of 10 minutes. Separation of microcrystalline wax (isolated wax centrifuge in a yield of 10 wt % base on the total amount of isolated wax and residual base oil) and diluted isomerized residual fraction was obtained by decantation. The Petroleum Ether was flashed from the diluted isomerized residual fraction in a laboratory rotavap apparatus in a temperature range 90-140° C. and 300 mbar pressure. The residual base oil obtained in a yield of 90 wt. % (based on the total amount of isolated wax and residual base oil) was found to be clear and bright at a temperature of 0° C. for a period of 7 hours. The kinematic viscosity according to ASTM D445 at 100° C. of the base oil at a temperature of 100° C. was 18.9 mm$^2$/s, a viscosity index of 153, a pour point was measured of pp=−42° C. and a cloud point of cp=−20° C. (see table 3).

Example 2

Using Solvent Dewaxing to Prepare and Obtain Hydrowax Residue, Isomerized Residual Fraction, Isolated Wax and Clear and Bright Residual Base Oil From a Fischer Tropsch derived hydrocarbon feed, through a hydrocracking step (60 bar, 330-360° C.) and subsequent atmospheric and vacuum distillation a vacuum hydrowax residue was obtained (congealing point=103° C.). This vacuum hydrowax residue (HVU bottom) was subjected to a catalytic dewaxing step and subsequent distillation. The isomerized residual fraction, with a density of D70/4=0.805, a kinematic viscosity according to ASTM D445 at 100° C. of 21.2 cSt, a pour point of PP=−24° C. and a cloud point of cp=42° C., was mixed with Heptane/Methyl Ethyl Ketone 50/50 weight percentage in a ratio of 4 parts by weight of diluents to 1 part by weight of isomerized residual fraction. The diluted isomerized residual fraction was heated to dissolve the wax and subsequently cooled to a temperature of −25° C. at a rate of 1° C. per minute. The cooled diluted isomerized residual fraction was filtered with a stack of Whatman filter papers (grades 41 and 42). The precipitated microcrystalline wax remained on the filter while the diluted isomerized residual fraction passed through the filter. The diluent was flashed from the diluted isomerized residual fraction in a laboratory rotavap apparatus in a temperature range of 135−160° C. at reduced pressure. The residual base oil obtained was found to be clear and bright at a temperature of 0° C. for a period of 7 hours. The kinematic viscosity at 100° C. was 19.8 cSt, the viscosity index was determined at 151, a pour point was measured of pp=−30° C. and a cloud point of cp=−16° C. (see table 3).

Example 3

$^{13}$C-NMR Spectroscopy

Quantitative $^{13}$C and APT (Attached Proton Test) NMR spectra were recorded using an Agilent 400 MHz spectrometer equipped with a 5 mm probe. To prepare NMR samples, approximately 25 wt % solution of isomerised residual fraction, clear and bright residual oil and wax isolated by centrifugation were prepared in deuterated chloroform solvent. The NMR sample of wax isolated via solvent extraction contained 13 wt % solution in $CDCl_3$. Spectra of these four samples were acquired at 40° C. To prepare an NMR sample of the hydrowax residual fraction, a small amount was scooped and dissolved in deuterated tetrachloroethane. To keep this sample in a liquid state, the temperature in the NMR spectrometer was raised to 120° C. All NMR samples for a quantitative analysis contained tris(acetylacetonato) chromium (III), which acted as a relaxation agent to induce the spin-lattice relaxation and reduce therefore $T_1$ relaxation time. Between 22000 and 10000 scans were acquired depending on the concentration of the sample. The relaxation delay was 5 s. For $^{13}$C NMR experiments an inverse gated decoupling scheme was used to suppress unwanted nuclear Overhauser enhancement (NOE). The spectra were processed and integrated using NutsPro—NMR Utility Transform Software—Professional from Acorn NMR. Chemical shifts were measured relative to tetramethylsilane (TMS) that was used as an internal standard. The peak assignments were based on the previous in-house work, on the literature reports, for example in pp. 483-490 of "Fuel", Sarpal et al, Vol. 75, No. 4, 1996, Elsevier. Chemical shifts predictions are generated by an NMR simulator, ACD/C+H NMR Predictors (ACD/C+H Predictors and DB 2012, version 14.00, Advanced Chemistry Development, Inc., Toronto, ON, Canada, www.acdlabs.com, 2012).

FIG. 1 shows the quantitative $^{13}$C NMR spectra of hydrowax residual fraction, isomerised residual fraction, clear and bright residual base oil and isolated wax samples in the 9-41 ppm region. These five spectra have an appearance of spectra typical for linear paraffins with methyl, ethyl and propyl or longer branches (propyl+). It is not possible to elucidate a full molecular structure of molecules in the base oils because a large number of carbons have the same chemical shift and therefore overlapping peaks. However, it is possible to identify various structural fragments and measure their relative amount, i.e. types of branching and the length of a non-branched segment. Table 2 contains assignments of the structural elements identified in the $^{13}$C spectra and their chemical shift. Using integrals' values (I), the following structural elements of the molecules comprising the four samples were determined. The average number of carbon atoms in the molecule was determined using formula 1. To determine the average number of carbon atoms per molecule the value of the total integral was divided by the value of the integral corresponding to the terminal carbons and multiplied by 2 to correct for two terminal carbons. In a similar manner, the number of carbon atoms in the non-branched portion of the molecule was determined using formula 2. Average number of methyl, ethyl and propyl+ branches per molecule was determined using formulas 3, 4 and 5, respectively. Average number of branches per molecule is a sum of number of methyl, ethyl and propyl+ branches. The results of these calculations are summarized in Table 2.

The average number of branches within a molecule should be considered together with the average molecular size as defined by the average carbon number of the molecules.

TABLE 1

Identified structures and their characteristic $^{13}$C chemical shift, δ

| Name | Structure | $^{13}$C chemical shift (ppm) |
|---|---|---|
| Aliphatic total | | 8-48 |
| Terminal methyl | 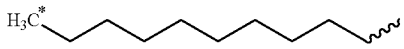 | 8-18 |
| Isopropyl branch | 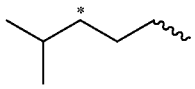 | 38.9 |
| Methyl branch at $C_3$ | 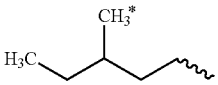 | 18.9 |
| Methyl branch at $C_4$ | 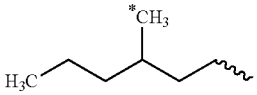 | 19.4 |
| Ethyl branch at $C_2$ | 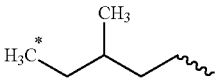 | 11.1 |

TABLE 1-continued

Identified structures and their characteristic $^{13}C$ chemical shift, δ

| Name | Structure | $^{13}C$ chemical shift (ppm) |
|---|---|---|
| Ethyl branch at $C_n$ | 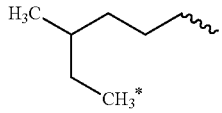 | 10.4 |
| Ethyl branch at $C_3$ | 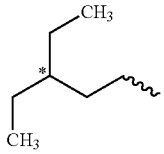 | 40.7 |
| Propyl+ branch | 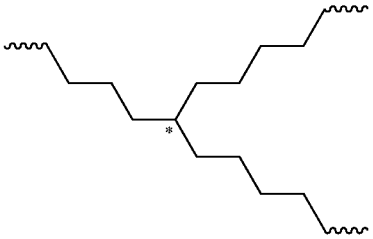 | 37.3, 37.6 |
| $C_4$ and $C_n$ (non-branched) | 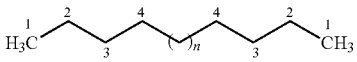 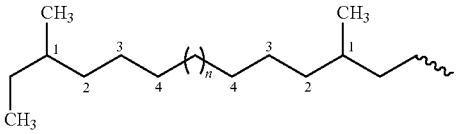 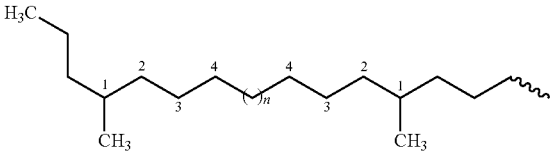 | 28.9-31.2 |

The signal from total aliphatic carbons, i.e. $I_{aliphatic\ total}=I_{8\text{-}48}$ The signal from non-branched methylene carbons, i.e. $I_{non\text{-}branched}=I_{28.9\text{-}31.2}$ The signal from the terminal groups $I_{terminal\ signal}=I_{40.7}+I_{8\text{-}18}+I_{38.9}-I_{37.3,\ 37.6}-I_{11.1}$ The signal from the methyl branches $I_{methyl\ branches}=I_{38.9}+I_{19.4}+I_{18.9}$ The signal from the ethyl branches $I_{ethyl\ branches}=I_{11.1}+I_{40.7}$ The signal from the propyl+ branches, $I_{propyl+}=I_{37.3,\ 37.6}$ Average number of carbons, $C_n^*=2^*I_{aliphatic\ total}/I_{terminal\ signal}$ (1)

Average $C_n$ non-branched, $C_n=2^*I_{non\text{-}branched}/I_{terminal\ signal}$ (2)

Average number of methyl branches per molecule$=2^*I_{methyl\ branches}/I_{terminal\ signal}$ (3)

Average number of ethyl branches per molecule$=2^*I_{ethyl\ branches}/I_{terminal\ signal}$ (4)

Average number of propyl+branches per molecule$=2^*I_{propyl+branches}/I_{terminal\ signal}$ (5)

TABLE 2

Structural parameters derived by NMR spectroscopy

| Sample | Average number of carbons per molecule, $C_n^*$ | Average number of carbons in the non-branched portion, $C_n$ | Average number of branches per molecule | Average number of branches normalized for a molecule of 50 carbon atoms |
|---|---|---|---|---|
| Hydrowax residual fraction | 52 | 26 | 2.9 | 2.8 |
| Isomerised residual fraction | 41 | 14 | 3.4 | 4.2 |

TABLE 2-continued

| Structural parameters derived by NMR spectroscopy | | | | |
|---|---|---|---|---|
| Sample | Average number of carbons per molecule, $C_n$* | Average number of carbons in the non-branched portion, $C_n$ | Average number of branches per molecule | Average number of branches normalized for a molecule of 50 carbon atoms |
| Clear and bright residual base oil | 35 | 11 | 2.9 | 4.2 |
| Isolated wax centrifuge | 43 | 19 | 2.6 | 3.1 |
| Isolated wax solvent dewaxing | 69 | 37 | 3.63 | 2.63 |

Example 4

Boiling Curves of the Fractions Isomerized Residual Fraction, Isolated Wax and Clear and Bright Residual Base Oil Boiling curves has been measured using simulated distillation using gas chromatography as described by ASTM D7169 while using iso-octane as the solvent instead of $CS_2$. The boiling curves can be found in FIG. 2.

Comparative Example 5

In a comparative experiment, the vacuum hydrowax residue used in experiment 1 was subjected to a dewaxing step operated at the same conditions that were applied in Example 1. In a third experiment not according to the invention Subsequently, the catalytic dewaxing unit effluent was distilled with a laboratory continuous atmospheric column in series with a short path distillation unit, as in example 2. The isomerized residual fraction, with a density of D70/4=0.805, a kinematic viscosity according to ASTM D445 at 100° C. of 21.3 mm2/s, a pour point of PP=−39° C. and a cloud point of cp=39° C., was mixed with Petroleum Ether (40/60) in a ratio of 2 parts by weight of diluent to 1 part by weight of isomerized residual fraction. The diluted isomerized residual fraction was cooled to a temperature of −20° C. In order to separate the microcrystalline wax and diluted residual base oil, the cooled diluted isomerized residual fraction was filtered with a stack of Whatmann filter papers (41/42/41) in a laboratory batch filtration device that was maintained at temperature of −20° C. The Whatmann filter 41 has been specified with a pore size from 20 to 25 μm and the Whatmann filter 42 with a pore size of 2.5 μm. The Petroleum Ether was flashed from the diluted residual base oil in a laboratory rotavap apparatus in a temperature range 90-140° C. and 300 mbar pressure. The base oil obtained was found to be hazy at a temperature of 0° C., a kinematic viscosity according to ASTM D445 at 100° C. of the base oil at a temperature of 100° C. was 21.0 mm2/s, a cloud point of cp=+26° C. (see table 3).

Comparative Example 6

In a comparative fourth experiment not according to the invention, the vacuum hydrowax residue used in experiment 1 was subjected to a dewaxing step operated at the same conditions that were applied in Example 1. Subsequently, the catalytic dewaxing unit effluent was distilled with a laboratory continuous atmospheric column in series with a short path distillation unit as in example 2. The isomerized residual fraction, with a density of D70/4=0.805, a kinematic viscosity according to ASTM D445 at 100° C. of 21.3 mm2/s, a pour point of PP=−39° C. and a cloud point of cp=39° C., was mixed with heptane in a ratio of 4 parts by weight of diluent to 1 part by weight of isomerized residual fraction. The diluted isomerized residual fraction was cooled to a temperature of −25° C. In order to separate the microcrystalline wax and diluted residual base oil, the cooled diluted isomerized residual fraction was filtered with a stack of Whattmann filter papers (41/42/41) in a laboratory batch filtration device that was maintained at temperature of −25° C. The Whatmann filter 41 has been specified with a pore size from 20 to 25 μm and the Whatmann filter 42 with a pore size of 2.5 μm. The heptane was flashed from the diluted residual base oil in a laboratory rotavap apparatus in a temperature range 90-140° C. and 300 mbar pressure. The base oil obtained was found to be hazy at a temperature of 0° C., a kinematic viscosity according to ASTM D445 at 100° C. of the base oil at a temperature of 100° C. was 20.6 mm2/s, a cloud point of cp=+19° C. (see table 3).

TABLE 3

| Properties base oil | Example 1 | Example 2 | Comparative Example 5 | Comparative Example 6 |
|---|---|---|---|---|
| Kinematic viscosity at 100° C. (cSt) | 18.9 | 19.8 | 21.0 | 20.6 |
| Pour point (° C.) | −42 | −30 | −30 | −30 |
| Cloud point (° C.) | −20 | −16 | +26 | +19 |
| Appearance at 0° C. | Clear and bright | Clear and bright | hazy | hazy |

Results and Discussion

After normalization to a similar carbon number, for example 50, a trend is observed (the last column in Table 2). The normalised branching number increases from 2.8 to 4.2 due to catalytic dewaxing. The removed wax has a significantly lower average number of branches per molecule of 3.07 (isolated by the centrifuge method) and 2.63 after solvent dewaxing which produces wax with a higher purity.

When branches are located on the second and the third carbon of the alkane chain, these structural elements will give rise to the peaks with a distinct chemical shift in the $^{13}C$ spectra. Therefore, their presence can be easily identified. The branches located on the fourth carbon and the branches located further on the alkane chain cannot be distinguished because all these branches will give rise to the $^{13}C$ peaks with very similar chemical shift and therefore overlapping. Thus, here reported average number of branches does not provide insight into the position of the branches. Therefore, the average non-branched chain length should also be taken into account. Not only a lower number of branches, but also a less even distribution of branches over the back-bone of the molecule yields a longer non-branched chain length. The data clearly shows a reduction of this feature due to catalytic dewaxing and subsequent wax removal. The longest non-branched chains are found in the waxy feed and in the isolated wax, especially in the wax that originates from solvent dewaxing.

Figure 2:
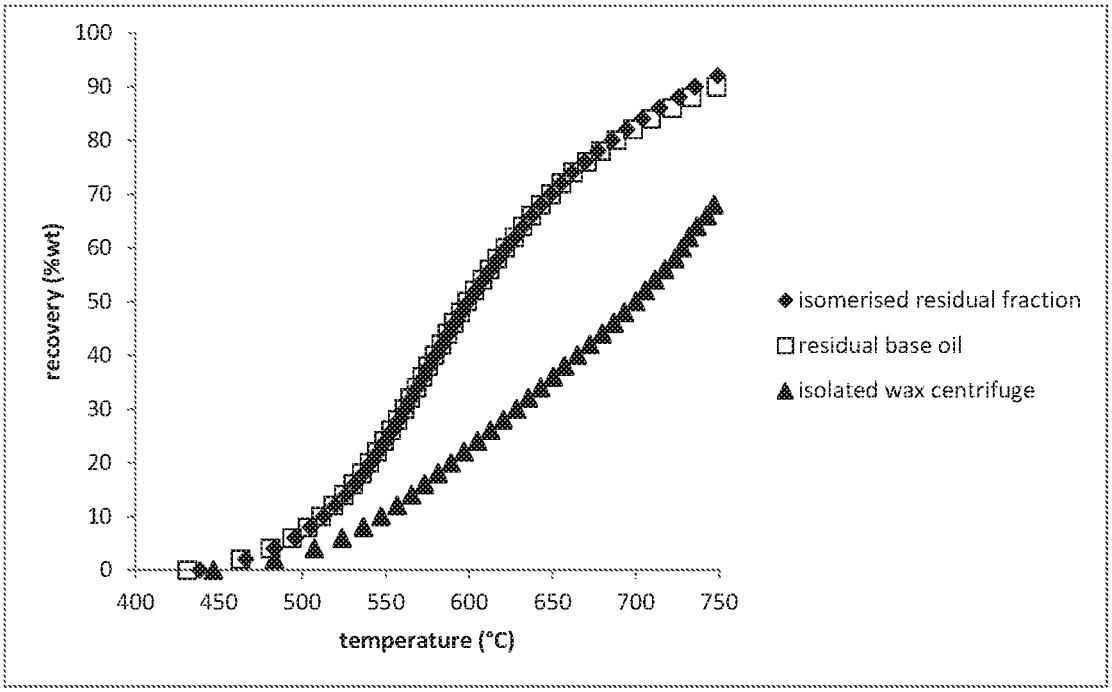
FIG. 2 show the boiling curves of the fractions isomerized residual fraction, isolated wax and clear and right residual base oil.

FIG. 2 shows that the boiling range of the isolated wax overlaps to a large extend with the clear and bright Fischer-Tropsch derived residual base oil. This means that the wax cannot be removed by distillation.

Example 1 shows that by using a centrifuging step a clear and bright Fischer-Tropsch derived residual base oil is obtained. In addition, the cloud point of the base oil in Example 1 has been reduced significantly compared to the cloud point before the centrifugation step. Also the kinematic viscosity at 100° C. of the clear and bright base oil is comparable to the isomerized residual fraction.

Example 2 show that by solvent dewaxing a clear and bright Fischer-Tropsch derived residual base oil is obtained. In addition, the cloud point of the base oil in Example 2 has been reduced significantly compared to the cloud points before solvent dewaxing. Also the kinematic viscosity at 100° C. of the clear and bright base oil is comparable to the isomerized residual fraction.

Comparative examples 5 and 6 show that in both experiments using a filtration step a hazy Fischer Tropsch derived residual base oil is obtained. In addition, the cloud points of the base oils in comparative Examples 5 and 6 have only been reduced moderately compared to the cloud points before the filtration step. In both cases, cloud point remains far above zero ° C.

What is claimed is:

1. A process for preparing a clear and bright Fischer-Tropsch derived residual base oil at 0° C. having a kinematic viscosity at 100° C. in the range of from 15 to 35 $mm^2/s$ according to ASTM D445, a cloud point of below 0° C. as measured according to ASTM D2500, and an average number of carbon atoms per molecule of the Fischer-Tropsch derived residual base oil according to $^{13}C$-NMR in a range of from 25 to 50, wherein the process comprises the steps of:

(a) providing a hydrocarbon feed which is derived from a Fischer-Tropsch process;

(b) subjecting the hydrocarbon feed of step (a) to a hydrocracking/hydroisomerisation step to obtain an at least partially isomerised product;

(c) separating at least part of the at least partially isomerised product as obtained in step (b) into one or more lower boiling fractions and a hydrowax residue fraction;

(d) catalytic dewaxing of the hydrowax residue fraction of step (c) to obtain a highly isomerised product;

(e) separating the highly isomerised product of step (d) into one or more light fractions and an isomerised residual fraction;

(f) mixing the isomerised residual fraction of step (e) with a diluent to obtain a diluted isomerised residual fraction;

(g) cooling the diluted isomerised residual fraction of step (f) to a temperature between 0° C. and −60° C.;

(h) subjecting the mixture of step (g) to a centrifuging step at a temperature between 0° C. and −60° C. to isolate the wax from the diluted isomerised residual fraction; and (i) separating the diluent from the diluted isomerised residual fraction to obtain the clear and bright Fischer-Tropsch derived residual base oil.

2. The process according to claim 1, wherein the clear and bright Fischer-Tropsch derived residual base oil has an average number of carbon atoms per molecule of the Fischer-Tropsch derived residual base oil according to $^{13}C$-NMR of from 30 to 45 carbon atoms.

3. The process according to claim 1, wherein the clear and bright Fischer-Tropsch derived residual base oil has an average number of carbon atoms per molecule of the Fischer-Tropsch derived residual base oil according to $^{13}C$-NMR of from 31 to 45 carbon atoms.

4. The process according to claim 1, wherein the clear and bright Fischer-Tropsch derived residual base oil has an average number of carbons in the non-branched segment according to $^{13}C$-NMR of less than 14 carbon atoms.

5. The process according to claim 1, wherein the clear and bright Fischer-Tropsch derived residual base oil has an average number of branches normalized for a molecule of 50 carbon atoms in according to 13 C-NMR of at least 3.5.

6. The process according to claim 1, wherein the clear and bright Fischer-Tropsch derived residual base oil has an average number of branches normalized for a molecule of 50 carbon atoms in according to 13 C-NMR of at least 4.0.

7. The process according to claim 1, wherein the clear and bright Fischer-Tropsch derived residual base oil has a T10 wt. % recovery point in the range of from 470 to 590° C., a T50 wt. % recovery point in the range of from 550 to 710° C., a T80 wt. % recovery point of at least 630° C. and a T90 wt. % recovery point of at least 700° C. as measured with ASTM D7169.

8. The process according to claim 1, wherein the clear and bright Fischer-Tropsch derived residual base oil has a pour point of less than −10 as measured according to ASTM D97.

9. The process according to claim 1, wherein the clear and bright Fischer-Tropsch derived residual base oil has a pour point of less than −20° C. as measured according to ASTM D97.

* * * * *